US008471180B2

(12) United States Patent
Cheng et al.

(10) Patent No.: US 8,471,180 B2
(45) Date of Patent: Jun. 25, 2013

(54) GLOW PLUG AND METHOD FOR CONNECTING A PIN MADE OF FUNCTIONAL CERAMIC TO A METAL SLEEVE

(75) Inventors: Yue Cheng, Liaoning (CN); Hans Peter Kasimirski, Ludwigsburg (DE); Helmut Mueller, Hessigheim (DE); Drazen Sajatovic, Asperg (DE)

(73) Assignee: BorgWarner BERU Systems GmbH, Ludwigsburg ( * ) Notice: Subject to any disclaimer, the term of this patent is extended or adjusted under 35 U.S.C. 154(b) by 53 days.

(21) Appl. No.: 12/873,482

(22) Filed: Sep. 1, 2010

(65) Prior Publication Data

US 2012/0043309 A1 Feb. 23, 2012

(30) Foreign Application Priority Data

Sep. 30, 2009 (DE) ..... 10 2009 048 643

(51) Int. Cl.
*F23Q 7/22* (2006.01)
*F23Q 7/00* (2006.01)

(52) U.S. Cl.
USPC ..... 219/267; 219/270; 219/544; 219/546; 123/145 A; 361/264; 361/265; 361/266; 338/233; 338/315; 29/611

(58) Field of Classification Search
USPC ..... 219/267, 270, 544, 546; 123/145 A; 361/264–6; 338/232–3, 315; 29/611
See application file for complete search history.

(56) References Cited

U.S. PATENT DOCUMENTS 5,880,432 A * 3/1999 Radmacher ..... 219/270
2010/0000982 A1 1/2010 Allgaier et al.

* cited by examiner

*Primary Examiner* — Shawntina Fuqua

(57) ABSTRACT

The invention relates to a glow plug comprising a housing in which an inner conductor is disposed, a metal sleeve which is inserted into the housing, and a ceramic glow pin which is disposed in the metal sleeve, wherein the two ends of the glow pin protrude from the metal sleeve and the rear end of the pin is connected to the inner conductor, and wherein the metal sleeve has a tapering section at the rear end, the section enclosing a tapering section of the glow pin. According to the invention, the glow pin is pressed into the metal sleeve. The invention further relates to a method for connecting a pin made of functional ceramic to a metal sleeve.

15 Claims, 5 Drawing Sheets

GLOW PLUG AND METHOD FOR CONNECTING A PIN MADE OF FUNCTIONAL CERAMIC TO A METAL SLEEVE

Glow plugs are known from DE 10 2006 016 566 A1. In order to produce the known glow plug, a metal sleeve and a glow pin, and an inner conductor and a glow pin, are brazed to each other. This creates the risk that solder bridges may form, which can result in short circuits.

It is the object of the invention to simplify the production of a glow plug of the type mentioned above and find a way to better avoid short circuits.

SUMMARY OF THE INVENTION

In the glow plug according to the invention, the glow pin is pressed into the metal sleeve. By pressing, a reliable and robust connection can be established between the ceramic glow pin and the metal sleeve in a cost-effective manner. Advantageously, in this way, simple and cost-effective production of the glow plug and an improvement in the centered position, coaxiality and longitudinal dimensional accuracy are enabled. As a result, the risk of short circuits due to solder bridges can be avoided. In addition, an extended service life can be achieved with a glow plug according to the invention. During brazing, high mechanical stresses occur due to different coefficients of expansion of the metal sleeve, brazing material and glow pin, which favor cracking and therefore can result in premature failure of the glow plug. Due to the different thermal coefficients of expansion of the metal sleeve, brazing material and glow pin, in particular an uneven coverage with brazing material can bring about shear forces, which produce cracks. Temperature-related stresses and the associated risk of cracking can advantageously be prevented according to the invention. It is furthermore advantageous that during operation the combustion chamber pressure acts in the pressing-in direction and thereby stabilizes the press fit.

The ceramic glow pin preferably has a ceramic inner conductor and a ceramic outer conductor, between which a ceramic insulator is disposed. Such a glow pin can be produced cost-effectively, for example, by baking an extruded green body. The metal sleeve can advantageously be used for contacting the outer conductor, so that the conductor can be connected to ground via the plug housing. As an alternative, however, it is also possible to use a ceramic glow pin, which comprises a metallic resistor embedded in a ceramic body.

According to an advantageous refinement of the invention, at least one annular ridge causes a local increase in the pressing pressure between the tapering section of the metal sleeve and the section of the glow pin covered thereby. The annular ridge can be provided on an inner surface of the metal sleeve or on the glow pin. As a result of such an annular ridge, an increased force can be caused locally between the metal sleeve and the glow pin. In this way, advantageously improved sealing can be achieved between the glow pin and metal sleeve. This is particularly advantageous in the case of pressure sensor glow plugs, because seepage of gases from the combustion chamber should be prevented to the extent possible and therefore the tightest possible connection between the glow pin and the metal sleeve is desirable. Another advantage of one or more annular ridges is that the end edge of the metal sleeve presses onto the glow pin with a lesser force. This advantageously reduces the risk of damage to the glow pin when pressing it in.

The tapering section of the glow pin preferably has a circular cross-section. However, in principle the tapering section of the glow pin can also be designed with edges, for example similar to a pyramid.

The tapering section of the metal sleeve and the tapering section of the glow pin can be shaped conically, that is, they can have the shape of a truncated cone. As an alternative, however, a concave shape may be selected. For example, in the tapering section, the glow pin may have a surface that has a concave longitudinal section and can be pressed into a conically shaped end section of the metal sleeve, for example. Given the concave shape, the angle of the contact surface continuously changes during the pressing-in operation, and the risk of damage to the glow pin is thereby reduced. A concave surface can be achieved in a glow pin by grinding, for example.

If the tapering section of the glow pin has a conical design, an angle of 5° to 10° is preferred for the bevel of the conical taper with respect to the longitudinal direction. This means that the quotient of the decrease of the radius of the glow pin in the tapering section thereof and the length of the tapering section ranges between 0.08 and 0.18. This region for the quotient of the decrease of the radius in the conically tapering section and the length of the tapering section is also preferred for glow pins in which the tapering section is not conically shaped, but instead, for example, is concavely shaped and/or has annular ridges. The decrease of the radius is the difference between the radius at the beginning of the glow pin section covered by the tapering end section of the metal sleeve and the radius at the rear end of the glow pin section covered by the metal sleeve.

The tapering section of the metal sleeve is preferably at least as long as the diameter of the metal sleeve at the widest point thereof.

The present invention further relates to a method for connecting a pin made of functional ceramic to a metal sleeve having a tapering end section, wherein the pin having a tapering section is pressed into the metal sleeve, so that the tapering section of the pin is covered by the tapering end section of the metal sleeve. To this end, it is sufficient if part of the tapering section of the pin is covered by the sleeve. When pressing in the pin, the metal sleeve is elastically and/or plastically deformed. The pressed-in pin is preferably a ceramic glow pin, however it can also be part of a gas or temperature sensor.

The ceramic pin is preferably pressed into a heated metal sleeve. In this way, the pressing-in force can advantageously be reduced. Because the metal sleeve subsequently cools off and contracts, advantageously the retaining force is increased and thereby the seal between the pin and metal sleeve is improved.

In the description of the present invention, the side facing the combustion chamber during operation is referred to as the front side and the side facing away from the combustion chamber during operation is referred to as the rear side of a component.

BRIEF DESCRIPTION OF THE DRAWINGS

Further details and advantages of the invention will be described based on exemplary embodiments with reference to the attached figures. In the drawings.

DETAILED DESCRIPTION

Figure 1:
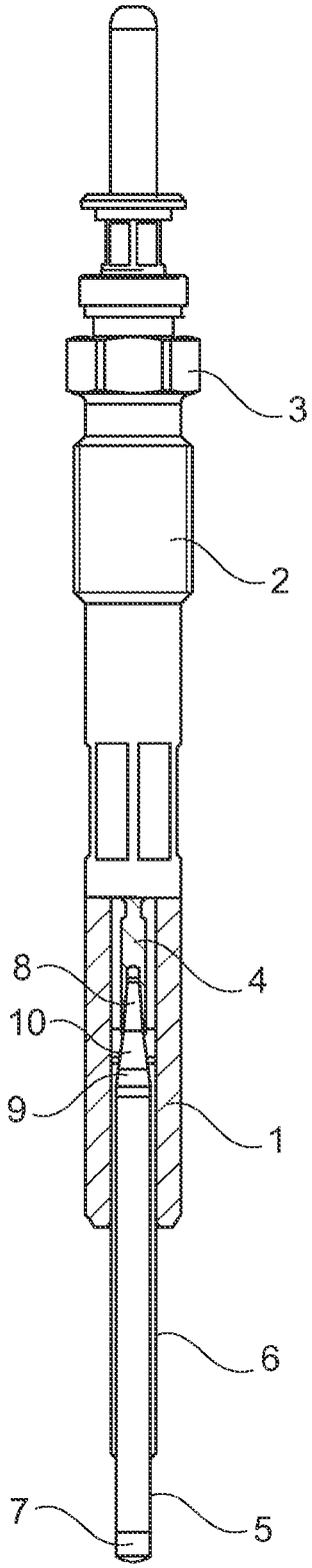
FIG. 1 is a schematic illustration of an exemplary embodiment of a glow plug.

FIG. 1 is a schematic illustration of an exemplary embodiment of a glow plug in a partially cut view. The glow plug comprises a metallic housing 1 having an external thread 2 and a hexagon 3. In the housing 1, a metallic inner conductor 4 is disposed, which is connected to the rear end of a ceramic glow pin 5 facing away from the combustion chamber. The ceramic glow pin 5 is pressed into a metal sleeve 6, which is inserted into the housing 1. Both ends of the glow pin 5 protrude from the metal sleeve 6 and the glow pin has a glow tip 7 at the front end thereof on the combustion chamber side.

The metal sleeve 6 is preferably pressed into the housing, however it can also be brazed or welded to the housing 1, for example. At the front end, the rod-shaped metallic inner conductor 4 has an opening into which the rear end of the glow pin 5 projects. The rear end of the glow pin 5 is preferably pressed into the inner conductor 4. It is also possible, however, to braze the inner conductor 4 to the glow pin.

In the illustrated exemplary embodiment, the ceramic glow pin 5 comprises a ceramic inner conductor 8 and a ceramic outer conductor 9, between which a ceramic insulator 10 is disposed. The ceramic inner conductor 8 and the ceramic outer conductor 9 are connected to each other in an electrically conductive manner by a ceramic heating resistor at the glow tip 7. The metal sleeve 6 electrically contacts the outer conductor 9 of the glow pin 5 and can be connected to ground potential by way of the housing 1. In the illustrated exemplary embodiment, the metal sleeve 6 is therefore both a contact tube and a protective tube. As an alternative, however, it is also possible to press on a contact tube or a contact ring and fasten it to a protective tube, such as by laser welding.

The front end of the glow pin 5 having the glow tip 7 is shown only schematically in FIG. 1. In the region of the glow tip 7, the glow pin 5 preferably has a reduced diameter, as is indicated in FIG. 2, which shows an exemplary embodiment of a metal sleeve 6 having a pressed-in glow pin 5 and metallic inner conductor 4.

Figure 2:
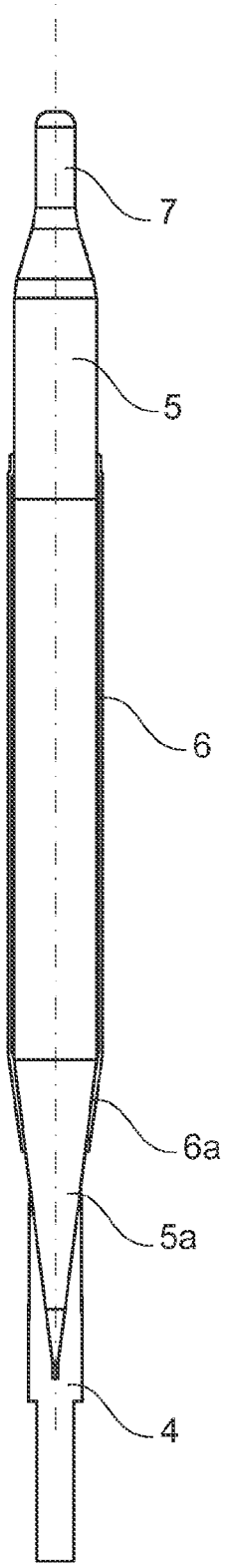
FIG. 2 is an exemplary embodiment of a metal sleeve having a pressed-in glow pin and inner conductor.
Figure 3:
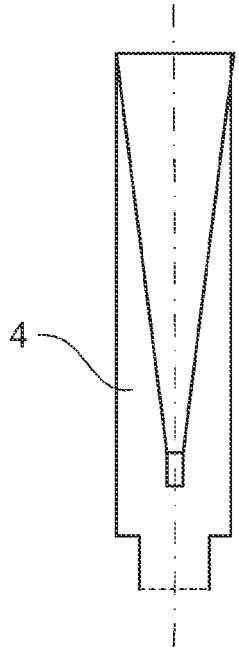
FIG. 3 is the inner conductor of the exemplary embodiment shown in FIG. 2.

As is particularly apparent from FIG. 2, the metal sleeve 6 has a tapering section 6*a* at the rear end thereof, the tapering section enclosing a tapering section 5*a* of the glow pin 5. In the illustrated exemplary embodiment, the tapering section 5*a* is an end section of the glow pin 5 and therefore brings about an advantageously large contact surface of the inner conductor 8 of the glow pin 5 with the metallic inner conductor 4. The inner conductor 8 of the glow pin 5 rests against the metallic inner conductor 4 with this contact surface. FIG. 3 shows, in detail, the front end of the metallic inner conductor 4 having the opening receiving the glow pin 5.

The glow tip 7 of the exemplary embodiment illustrated in FIG. 2 has an outside diameter of 3.3 mm. The bezel angles of the section 5*a* of the glow pin 5 and of the end section 6*a* of the metal sleeve 6 are approximately 7° in each case. The illustrated metal sleeve 6 has a maximum inside diameter of 3.4 mm and a wall thickness of 0.4 mm to 0.6 mm, for example 0.5 mm. The glow pin 5 was pressed centrically into the metal sleeve 6 with a force of approximately 2 to 2.5 kN. Prior to being pressed in, the metal sleeve 6 was heated, so that it is thermally shrink-fitted onto the glow pin 5 as it cools down and the retaining force is increased.

Figure 4:
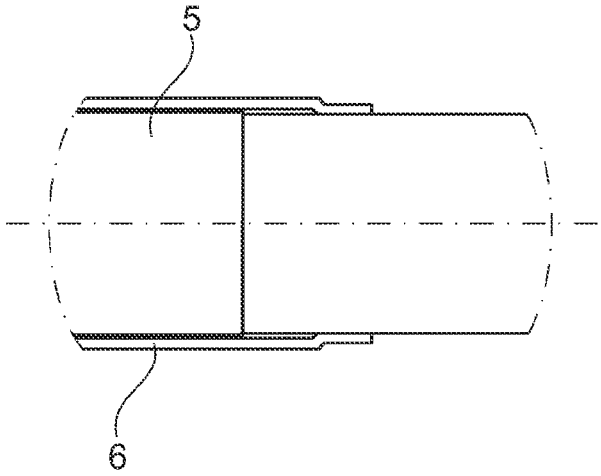
FIG. 4 is a detailed view of FIG. 2.

FIG. 4 shows a detailed view of FIG. 2. In this detailed view, the front end of the metal sleeve 6 is shown. It is apparent that the metal sleeve 6 is pressed together in the front end region, for example it is crimped together. Behind the pressed-together end region, the diameter of the glow pin 5 increases, such as by 0.1 mm to 0.5 mm. If the glow pin 5 should break in the metal sleeve 6, in this way a broken glow pin fraction can be prevented from falling out of the metal sleeve 6 because the site of the sleeve 6 that is pressed together can preferably create a form fit with the, preferably stepped, diameter expansion of the glow pin 5. In the illustrated exemplary embodiment, the metal sleeve 6 is pressed together at the front end thereof. In order to fulfill the retaining function described above, the metal sleeve 6, however, can also be pressed together at a site that is disposed at a distance from the front end, but is located in the front end region.

Figure 5:
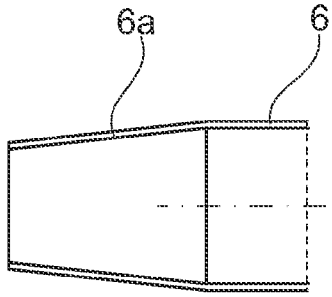
FIG. 5 is a detailed view of the end section of the metal sleeve.

The tapering end section 6*a* of the metal sleeve 6 and the section of the glow pin 5 covered thereby can be conically shaped. One example of a conically shaped end section 6*a* of the metal sleeve 6 is shown in FIG. 5. The bezel angle of the end section 6*a* is preferably between 5° and 10°.

Figure 6:
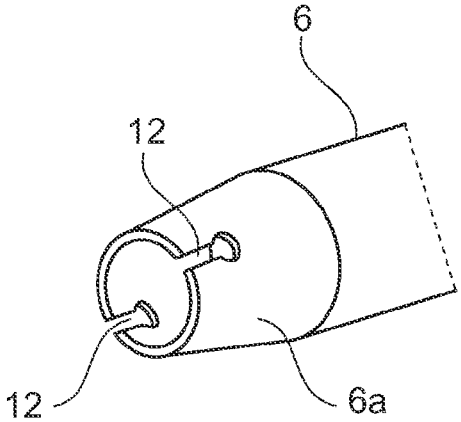
FIG. 6 is a further exemplary embodiment of the metal sleeve.

In order to reduce the stress on the glow pin 5 and achieve a particularly strong connection, the rear end of the metal sleeve 6 may be provided with one or more notches. A corresponding exemplary embodiment is illustrated in FIG. 6. As an alternative or in addition, the stress on the glow pin 5 can also be reduced in that the metal sleeve 6 has a reduced wall thickness at the rear end thereof. The wall thickness can be reduced uniformly, notably in a linear fashion, in the tapered end section 6*a*. It is also possible for the wall thickness to be reduced in steps, or continuously, but not in a linear fashion, in the tapering end section 6*a*.

Figure 7:
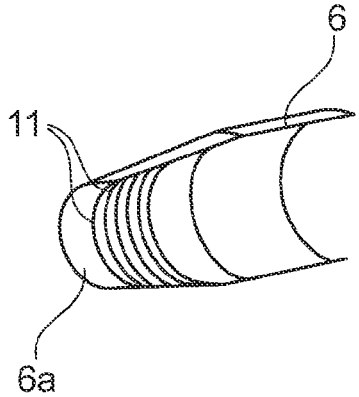
FIG. 7 is a further exemplary embodiment of the metal sleeve.

FIG. 7 shows the end section of a further exemplary embodiment of a metal sleeve 6. In this exemplary embodiment, the tapering end section 6*a* of the metal sleeve 6 has several annular ridges 11 at the inside, wherein these ridges cause a local increase in the pressing pressure between the end section 6*a* of the metal sleeve 6 and the section of the glow pin 5 covered thereby. In this way, advantageously an improved seal is achieved between the metal sleeve 6 and the glow pin 5.

Figure 8:
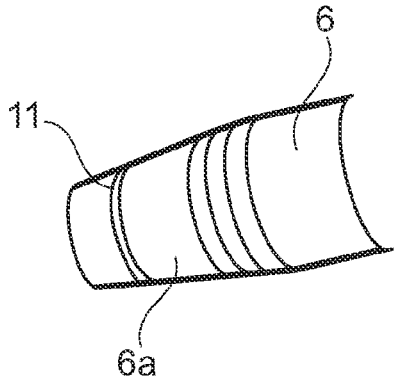
FIG. 8 is a further exemplary embodiment of the metal sleeve.

FIG. 8 shows the end section of a further exemplary embodiment of a metal sleeve. In this exemplary embodiment, the tapering end section of the metal sleeve has only a single annular ridge 11 on the inside. This annular ridge 11 reduces stress peaks at the rear end of the metal sleeve 6. The annular ridge illustrated in FIG. 8 was produced as a constriction on the metal sleeve.

The exemplary embodiments illustrated in FIGS. 7 and 8 can additionally be provided with one or two notches 12 at the rear ends, as was explained in relation to FIG. 6. In addition, in the exemplary embodiments illustrated in FIGS. 7 and 8, the metal sleeve 6 can have a reduced wall thickness at the rear end.

In the case of a conical shape of the tapering sections 5*a*, 6*a* of the metal sleeve 6 and the glow pin 5, angles of 5° to 10° of the lateral surface with respect to the longitudinal direction are particularly advantageous. If both the tapering section 6*a* of the metal sleeve 6 and the tapering section 5*a* of the glow pin 5 have conical shapes, the sealing effect between the glow pin 5 and the metal sleeve 6 can be increased in that the angle of the glow pin 5 is selected smaller than the angle of the metal sleeve 6 into which the glow pin is pressed. In order to achieve the improved seal, an angular difference of one degree or less, such as 0.1° to 1°, is sufficient.

By selecting the angle of the glow pin 5 smaller than the angle of the metal sleeve 6, prior to the pressing-in operation the ratio of the inside radius of the metal sleeve 6 at the beginning of the tapering end section 6*a* to the inside radius at the rear end of the metal sleeve 6 is greater than the ratio of the radii of the glow plug 5 at the two corresponding locations against which the beginning of the tapering end section 6*a* and the end of the metal sleeve 6 rest after the pressing-in operation. This advantageously brings about an increased pressure at the end of the end section 6*a* of the metal sleeve 6 and thereby a good sealing effect.

Figure 9:
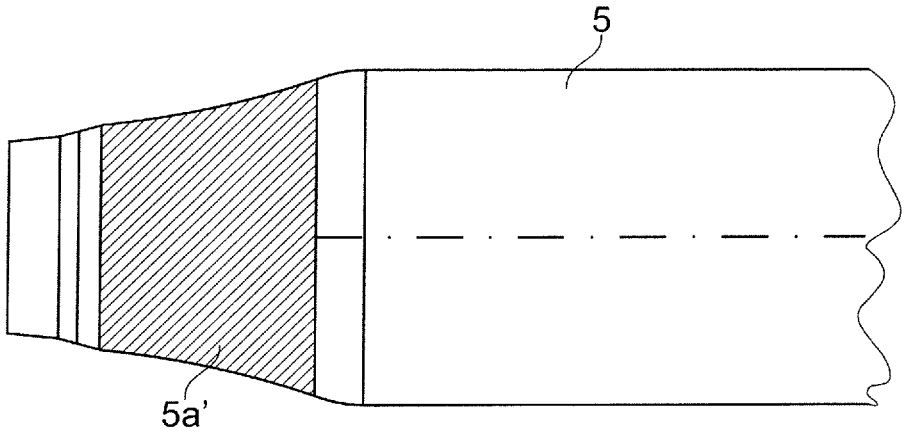
FIG. 9 is an exemplary embodiment of the glow pin.

Instead of using conically shaped sections 5*a*, 6*a* of the metal sleeve 6 and the glow pin 5 having different angles, the same effect can also be achieved by using a glow pin 5, the tapering section 5*a* of which comprises a surface having a concave longitudinal section in the region 5*a*' covered by the end section 6*a* of the metal sleeve 6. A corresponding exemplary embodiment of a glow pin is schematically illustrated in FIG. 9. In order to provide a clearer illustration, the contours in FIG. 9 are not shown to scale, but slightly larger. The region 5*a*' covered by the end section 6*a* of the metal sleeve 6 is highlighted with hatching in FIG. 9.

In the exemplary embodiment illustrated in FIG. 9, the quotient of the decrease of the radius of the glow pin 5 in the part 5*a*' of the tapering section 5*a* covered by the metal sleeve 6 and the length of the tapering section 5*a*' enclosed by the metal sleeve 6 after the pressing-in operation ranges between 0.08 and 0.18. A cone tangent to the corners of the annular regions of the glow pin 5 at the beginning and at the end of the partial section 5*a*' covered by the end section 6*a* of the metal sleeve 6 then has a bezel angle between 5° and 10°.

Figure 10:
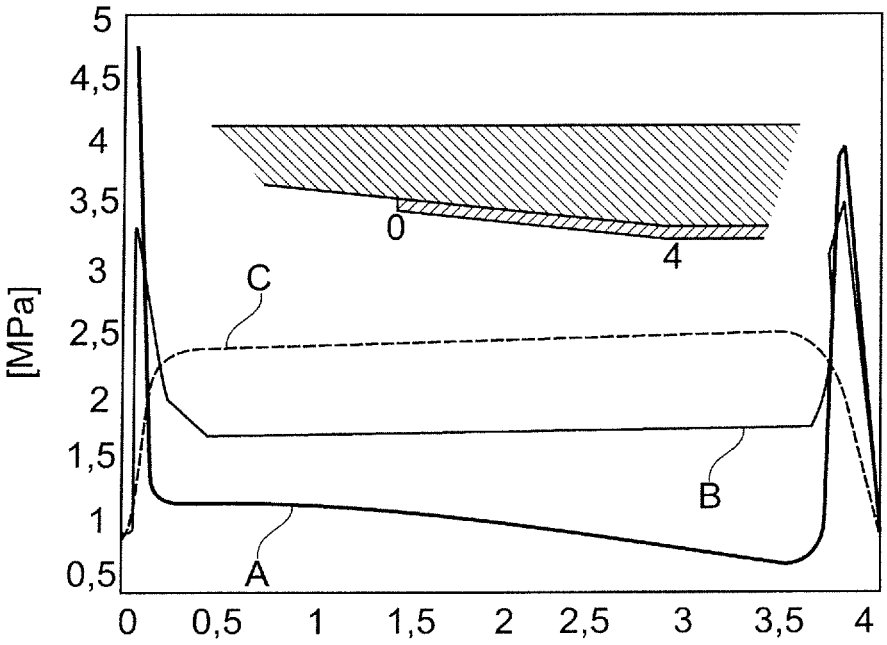
FIG. 10 are examples of pressure curves in the end section of the metal sleeve.

FIG. 10 shows examples of the curves of the pressure present between the metal sleeve 6 and the glow pin 5 in the tapering end section 6*a* of the metal sleeve 6. In FIG. 10, the pressure is plotted in MPa over the distance of the end section 6*a* in arbitrary units for different glow plugs. The rear end of the metal sleeve 6 provides the zero point of the X-axis, the front end of the tapering region of the metal sleeve provides the value 4 on the X-axis.

Curve A describes the course of the pressure for a metal sleeve 6 having a conically shaped end section 6*a* according to FIG. 5, into which a glow pin 5 is pressed, the end section of which tapers at the same angle. Curve B shows the course of forces for a glow pin 5 comprising a surface that has a concave longitudinal section in a region 5*a*' covered by the end section 6*a* of the metal sleeve 6, according to the exemplary embodiment illustrated in FIG. 9. This glow pin 5 was pressed into a metal sleeve 6, which is conically tapered slightly less toward the end, as was explained based on FIG. 9. In this way, advantageously a uniform curve of the pressure between the two pressure peaks at the beginning and at the end of the tapering end section 6*a* of the metal sleeve 6 is obtained.

Curve C indicates the course of the pressure for a metal sleeve 6 which has recesses 12 at the end section 6*a* in order to avoid pressure peaks. Contrary to the exemplary embodiment illustrated in FIG. 6, recesses 12 were provided at both ends of the tapering end section 6*a*.

Figure 11:
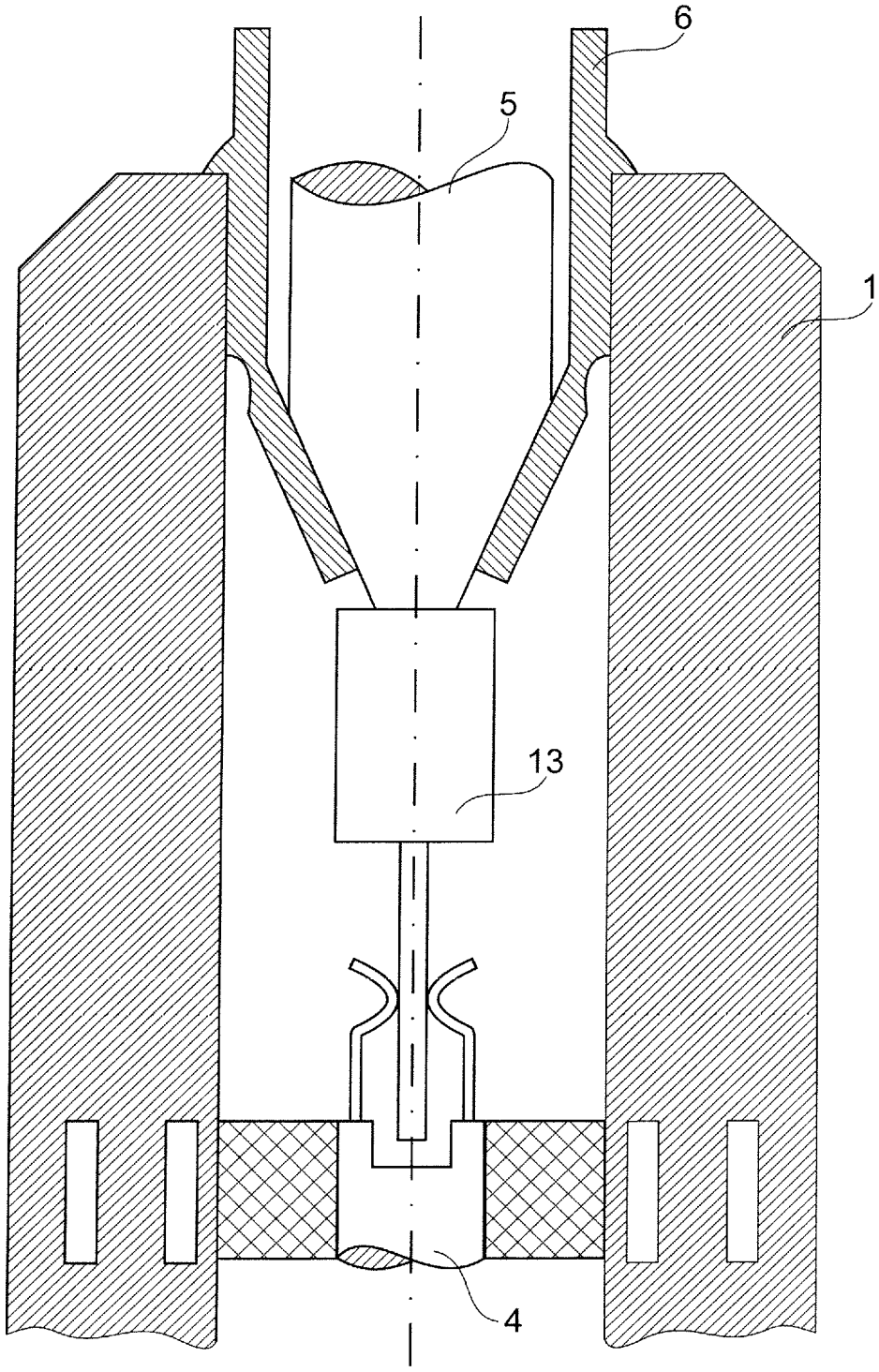
FIG. 11 is an exemplary embodiment for connecting the glow pin to the metallic inner conductor of the glow plug.

FIG. 11 shows an exemplary embodiment for connecting the glow pin 5 to the metallic conductor 4 of the glow plug. As an alternative for pressing the glow pin 5 into the inner conductor 4 or for brazing the glow pin 5 to the inner conductor 4, a contact pin 13 may be placed on the tip of the glow pin 5, the pin being connected to the inner conductor 4 via a plug connection, as is shown schematically in FIG. 11. The contact pin 13 can advantageously be placed on the glow pin 5 after the pin has been pressed into the metal sleeve 6. When pressing the metal sleeve 6 into the housing 1 of the glow plug, in this way also a connection of the glow pin 5 to the inner conductor 4 is brought about.

REFERENCE NUMERALS

1 Housing
2 External thread
3 Hexagon
4 Metallic inner conductor
5 Glow pin
5*a* Section
5*a*' Partial region of 5*a*
6 Metal sleeve
6*a* Section
7 Glow tip
8 Ceramic inner conductor
9 Ceramic outer conductor
10 Insulator
11 Ridge
12 Notch
13 Contact pin

What is claimed is:

1. A glow plug, comprising:
a housing in which an inner conductor is disposed,
a metal sleeve which is inserted into the housing, and
a ceramic glow pin disposed in and protruding from the metal sleeve at two ends,
the two ends of the ceramic glow pin protruding from the metal sleeve comprising a rear end opposite a combustion chamber end,
the rear end of the ceramic glow pin being connected to the inner conductor,
the metal sleeve having a metal sleeve tapering section at the rear end,
the ceramic glow pin having a ceramic glow pin tapering section at the rear end,
the metal sleeve tapering section enclosing the ceramic glow pin tapering section,
wherein the ceramic glow pin is pressed into the metal sleeve,
wherein the ceramic pin tapering section reduces in taper moving from the ceramic glow pin towards the inner conductor.

2. The glow plug according to claim 1, wherein the metal sleeve has a notch at the rear end.

3. A glow plug according to claim 1, wherein at least one annular ridge causes a local increase in the pressing pressure between the metal sleeve tapering section and the ceramic glow pin tapering section.

4. A glow plug according to claim 1, wherein the metal sleeve has an inner surface having at least one annular ridge in the metal sleeve tapering section.

5. A glow plug according to claim 1, wherein the ceramic glow pin has at least one annular ridge, which is covered by the metal sleeve, in the ceramic glow pin tapering section.

6. A glow plug according to claim 1, wherein the metal sleeve has a reduced wall thickness at the rear end.

7. A glow plug according to claim 1, wherein the ceramic glow pin comprises a surface having a concave longitudinal section in the ceramic glow pin tapering section.

8. A glow plug according to claim 1, wherein the quotient of the decrease of the radius of the ceramic glow pin tapering section along the length of the ceramic glow pin tapering section ranges between 0.08 and 0.18.

9. A glow plug according to claim 1, wherein the metal sleeve is pressed together in a front end region.

10. A method for connecting a pin made of functional ceramic to a metal sleeve, the pin having a pin tapering end section, wherein the pin tapering end section is pressed into the metal sleeve having a metal sleeve tapering end section so that the pin tapering end section is partially covered by the metal sleeve tapering end section.

11. The method according to claim 10, wherein an inner surface of the metal sleeve tapering end section before the pin is pressed within has a different shape than the outside surface of the pin tapering end section, wherein the difference between the two shapes is reduced by the pressure on the end of the metal sleeve during the pressing-in operation.

12. The method according to claim 10, wherein prior to the pressing-in operation, the ratio of a first inside radius of the metal sleeve tapering end section at the beginning of the metal sleeve tapering end section to a second inside radius at the rear end of the metal sleeve tapering end section is greater than the ratio of the radii of the pin at the two locations against which the beginning of the metal sleeve tapering end section and the rear end of the metal sleeve tapering end section rest after the pressing-in operation.

13. A method according to claim 10, wherein the pin is pressed into a heated metal sleeve.

14. A glow plug, comprising:

a ceramic glow pin comprising a combustion chamber end opposite a rear end, the ceramic glow pin comprising a tapered end disposed at the rear end, the tapered end reducing in taper moving from the combustion chamber end towards the rear end;

a metal sleeve enclosing the ceramic glow pin at least along a portion of the tapered end; and an inner conductor connected to the rear end of the ceramic glow pin.

15. The glow plug of claim 14, including a housing disposed around a portion of the ceramic glow pin and around the metal sleeve and inner conductor.

* * * * *